United States Patent [19]

Karle

[11] Patent Number: 4,840,155

[45] Date of Patent: Jun. 20, 1989

[54] FUEL INJECTION PUMP

[75] Inventor: Anton Karle, Leonberg, Fed. Rep. of Germany

[73] Assignee: Robert Bosch GmbH, Stuttgart, Fed. Rep. of Germany

[21] Appl. No.: 187,082

[22] Filed: Apr. 27, 1988

[30] Foreign Application Priority Data

May 11, 1987 [DE] Fed. Rep. of Germany ..... 3715614

[51] Int. Cl.[4] ..... F02M 39/00

[52] U.S. Cl. ..... 123/300; 123/506

[58] Field of Search ..... 123/300, 299, 506, 458, 123/449, 503

[56] References Cited

U.S. PATENT DOCUMENTS 4,510,908 4/1985 Etsele ..... 123/506
4,530,337 7/1985 Laufer ..... 123/300
4,546,749 10/1985 Igashira ..... 123/506
4,633,836 1/1987 Faupel ..... 123/506
4,745,898 5/1988 Egler ..... 123/300

*Primary Examiner*—Carl Stuart Miller
*Attorney, Agent, or Firm*—Michael J. Striker

[57] ABSTRACT

A fuel injection pump, capable of providing a preliminary fuel injection and a main fuel injection, includes a pump piston movable in a housing to define a pump working chamber which is connected with a fuel injection valve during the pumping stroke of the piston. The working chamber is relieved by the valve-closing member of the pressure valve. A magnetic valve which controls the function of the pressure-closing member is provided in the pump. An opening pressure of the pressure valve is greater than that of the fuel injection valve so that the preliminary injection is obtained with the initially open magnetic valve whereas the duration of the main fuel injection is controlled by the closed magnetic valve.

11 Claims, 1 Drawing Sheet

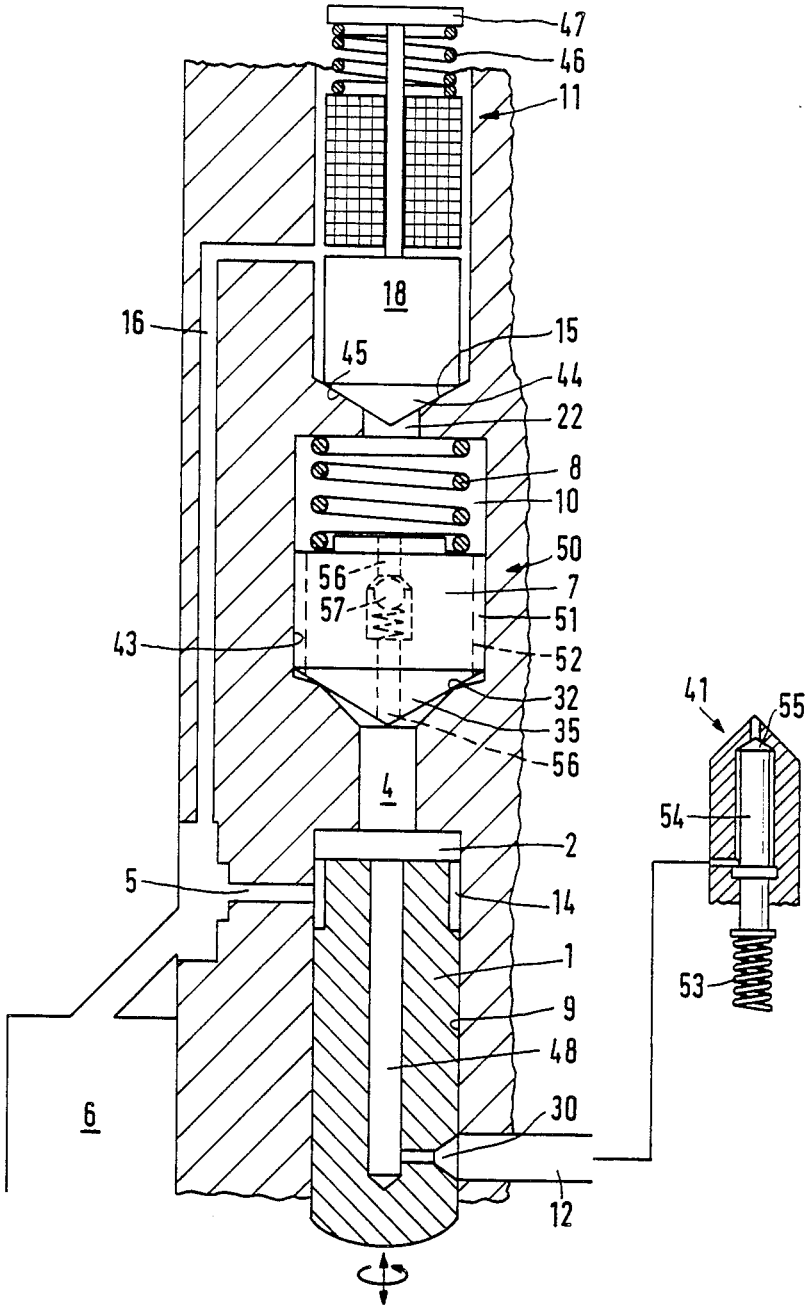
47
46
11
18
16
15
45
44
22
8
10
50
56
7
57
51
43
52
32
41
55
35
56
4
54
2
5
14
1
53
9
48
6
30
12

FUEL INJECTION PUMP

BACKGROUND OF THE INVENTION

The present invention relates to a full injection pump in general, and more particularly to a distributor type fuel injection pump for injecting high pressure fuel into combustion chambers of an internal combustion engine.

One of the known fuel injection pumps of the type under discussion is disclosed in U.S. Pat. No. 4,449,504. In this known fuel injection pump, the valve-closing member is formed as a cylindrical reciprocating piston which is tightly guided in the cylindrical bore which opens into the pump working chamber. The fuel-unloading chamber is opened, during the idle mode of operation of the internal combustion engine by an electrically-pneumatically operated valve, towards the second unloading conduit or passage, so that the reciprocating piston can be adjusted, due to the pressure prevailing in the pump working chamber during the advancement of the pump piston, by a predetermined path defined by the pre-stressing of the restoring spring and by a stop. Thereby the pumping rate during the idle mode of operation is reduced while the fuel injection is not, however interrupted. Such devices serve to make smoother the combustion process, with the fuel injection pumps operated with low speeds. The second unloading passage is either continually opened during the idle mode of operation or is continually closed during a partial or full loading of the engine.

Also known is a device including injection nozzles. Such a device has been disclosed in DE-OS No. 33 00 876. These nozzles provide a preliminary fuel injection. There preliminary injection devices have the disadvantage that the preliminary injection must be carried out before the main injection and the additional devices to enable such a preliminary injection are rather expressive and require throttles which strongly throttle the fuel when the speed rises. In addition, the preliminary injection is strongly changed with dynamic operation ratios.

A further disadvantage of conventional devices resides in that the fuel pumps do not ensure unloading in all load ranges.

SUMMARY OF THE INVENTION

It is an object of the present invention to provide an improved fuel injection pump for an internal combustion engine.

It is another object of the invention to provide a fuel injection pump which would ensure a preliminary injection in the entire speed-load range and which would variably adjust an interval between the preliminary injection and the main injection.

With the pump according to the invention, only one control device for many injection nozzles is required. The control device can operate with an individual pressure valve or a pressure-equalizing valve and is formed so that jumping off of the pump piston drive from the drive cam is prevented.

These and other objects of the invention are attained by a fuel injection pump for internal combustion engines, comprising housing means defining a pump working chamber; at least one pump piston movably guided in said working chamber and limiting the same; a fuel injection valve; means to connect said chamber to said fuel injection valve during an advancement stroke of said piston to open or close the fuel injection valve, said housing means including a first unloading passage connected to said chamber, said housing means further including an unloading chamber connectable to said first unloading passage, and a second unloading passage connected to said unloading chamber to unload the latter; a controlling member controlling said first unloading passage to close or open the latter; a restoring spring positioned in said unloading chamber and biasing said controlling member in a direction of closing, said first unloading passage limiting a valve seat with which said controlling member cooperates as a valve closing member, said controlling member being formed so that an opening pressure thereof is higher than the opening pressure of said fuel injection valve.

The valve closing member may be formed as a pressure equalizing valve.

The unloading chamber may be cylindrical and said valve closing member may include a cylindrical portion slidable in said unloading chamber, said cylindrical portion having a diameter which is greater than a diameter of said valve seat, said cylindrical portion being provided with overflow passages.

An electrically actuated valve may be provided to close and open said second unloading passage.

The electrically actuated valve may be an electromagnetic valve.

The electro-magnetic valve may be coaxial to said valve closing member.

The valve closing member has a backside, said restoring spring acting on said backside and being adjustable in dependence upon operational parameters of the internal combustion engine.

One of said first and second unloading passages may have a variable flow through cross-section whereas an opening phase of said electrically actuated valve is adjustable before an end of a fuel injection.

The pump of the invention may be formed as a distributor type fuel injection pump.

The objects of the invention are also attained by a method for controlling a fuel injection pump for an internal combustion engine with periodical cycles of pump piston pump motions and high pressure formation for fuel injection nozzles with a control of a duration of a high pressure pump motion per pump cycle for controlling an amount of fuel being injected, the method comprising the steps of providing in the fuel injection pump a pump working chamber limited by a pump piston, a fuel injection valve connected to said working chamber, a first unloading passage connected to said chamber, an unloading chamber connectable to said first unloading passage, and a second unloading passage connected to said unloading chamber to unload the latter; controlling said first unloading passage with controlling a high pressure pump rate by controlling an amount of fuel removed by a fuel unloading member which periodically permits high pressure to said pump working chamber or pressure to said unloading chamber; providing an electrically-actuated valve to open and close said unloading chamber, the improvement comprising the steps of opening said electrically-actuated valve in a first operating range of the fuel injection pump for controlling the amount of injected fuel during the start of a pump stroke of the pump piston; closing said valve after a predetermined piston pump stroke and opening said valve again for ending the fuel injection; forming said fuel unloading member as a pressure valve operated with an opening pressure which is higher than an opening pressure of said fuel injection valve, and closing said electrically-actuated valve in a second operating range for starting the pumping of said piston and opening said electrically-actuated valve for ending the fuel injection.

The electrically-actuated valve may be an electromagnetic valve the closing of which can vary an interval between a preliminary fuel injection and a main fuel injection.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing is a sectional view through the fuel injection pump according to the invention.

DETAILED DESCRIPTION OF THE PREFERRED EMBODIMENTS

Referring now to the drawing in detail it will be seen that the sole figure schematically shows a sectional view of the one part of the distributor type fuel injection pump the remaining portion of which is known, for example from the aforementioned U.S. Pat. No. 4,449,504, which is incorporated herein by reference. A pump piston 1 is guided in a cylinder 9 so that a non-shown but known cam drive imparts to the piston 1 a reciprocal and rotational movement in synchronism with the operation of the internal combustion engine to pump fuel thereinto. The pump piston 1 defines a pump working chamber 2. The pump working chamber 2 is filled with fuel via filling grooves 14 which are periodically connected, during the suction stroke of the pump piston 1, with a suction passage 5. The latter branches off from a suction chamber 6 which is filled with fuel loaded with a speed-dependent pressure. The pump piston 1 of the fuel injection pump acts in the known fashion during operation, as a fuel distributor, whereby fuel, through an elongated distributor bore 48, is pumped from the pump working chamber 2, via an injection passage or conduit 12, into an injection valve 41. An unloading passage 4, which cooperates with a valve closing member 7, which controls this unloading passage 4, leads from the pump working chamber 2. The valve closing member 7 is a part of the pressure valve 50 and has on the underside a valve cone 35 which cooperates with a valve seat 32 provided at the unloading passage 4. The valve locking member 7 has on its shaft guiding ribs 51 which are guided back and forth in a cylinder 43 which surrounds the pressure valve 50. The valve closing member is formed on the periphery thereof with elongated grooves 52 which start at the valve cone 35. At the side, opposite to valve cone 45, the valve closing member 7 is loaded with a restoring string 8. The latter is pre-stressed in the unloading chamber 10 so that the valve closing member 7 is pressed against the valve seat 32. The restoring spring 8 is accommodated in the cylindrical unloading chamber 10, from which a second unloading passage 22, formed with a valve seat 15, extends upwardly. The valve seat 15 cooperates with a valve closing member 18 of an electrically-controlled valve which is here an electro-magnetic valve 11. The valve closing member 18 is formed as an armature of the electro-magnetic valve and has a conical apex or tip 44 which has a sealing surface 45 which comes into contact with the valve seat 15 of the second unloading passage 22. A feedback passage 16 connects the unloading chamber 10, via the valve seat 15 and second unloading passage 22, with the suction chamber 6. If no current flows through the armature of the electro-magnetic valve 11 in the non-controlled state thereof it is lifted from the valve seat 15 by means of a spring 46 which cooperates with a part 47 connected to the armature.

The mode of operation of the distributor type fuel injection is as follows:

When pump piston 1 is moved in the downward direction by the non-shown cam drive, the fuel is conveyed through the feeding or suction passage 5 and filling grooves 14 into the pump working chamber 2. During the following pump stroke of the pump piston 1, pressure is built up in the pump working chamber 2, elongated bore 48 of the pump piston 1, first unloading passage 4, distributor groove 30, injection passage 12 and on a valve needle 54 loaded with a compression spring 53 of the injection valve 41. This built-up pressure reaches such a value that the valve needle 54 is lifted from a valve seat 55 against the force of spring 53, and a fuel injection takes place. Upon further rising of the pressure in the pump working or fuel compression chamber 2, the force of the restoring spring 8 of the valve-closing member 7 is overcome, and the fuel can now flow through elongated grooves 52 of the valve-closing member 7 into the unloading chamber 10, second unloading passage 22, which is open in the noncontrolled position, and, through the feedback passage 16, back into the suction or fuel supply chamber 6. With the opening process, the valve-closing member 7, is suddenly loaded over the large surface with the pressure of the pump working chamber and is quickly brought to a completely open position. As the fuel flows back into the suction chamber 6, the pressure in the pump working chamber 2 is reduced so that it falls below the level which was available at the beginning of operation in order to press the valve needle 54 away from the valve seat 55, and this causes a preliminary injection. During the closing motion of the injection valve 41, the magnetic valve 11 is, at the same time, controlled, or switched on, whereby the valve surface provided on the armature 18 presses against the valve seat 15 and closes the second unloading conduit 22. Due to the pressure again rising in the pump working chamber 2, which results from a further rotation of the cam drive the afore-described structural components are again loaded with pressure, and the valve-closing member 7 is again brought to the closed position by the restoring spring 8. The further pumped fuel can now flow, through the elongated bore 48 in the pump piston 1, distributor groove 30, injection passage 12, to the injection valve 41. The valve needle 54 of the injection valve 41 is thereby lifted from the valve seat 55 and the main injection starts. The duration of injection is determined by the time during which the magnetic valve 11 remains closed. When the electromagnetic valve 11 is opened the backside of the valve- closing member 7 is impact-like unloaded, and the valve-closing member 7 immediately opens due to a high pressure in the pump working chamber 2 so that this chamber is unloaded, and the fuel injection is terminated.

A modified embodiment of the invention is shown in the drawing by a broken line. In the modified embodiment, a through bore 56 is formed in the valve-closing member 7. A spring-biased ball valve 57, flow-loadable from the chamber 10, is accommodated in the through bore 56. No feeding passage similarly to passage 5 to connect the pump working chamber with the suction chamber 6 is required in this embodiment. Instead of the ball-shaped valve 57 inserted in the valve-closing member 7 can also be formed a passage with a ball valve, extending around the valve-closing member 7.

Due to the aforedescribed devices, the fuel can flow from the suction chamber 6, via feedback passage 16, through bore 56, ball valve 57 and first unloading passage 4 into the pump working chamber 2.

A further possible modification resides in that the adjustment of the valve-closing member 7 would be carried out by means of a two-stage magnetic valve in such a fashion that, after the opening of the valve-closing member 7, the first stage of the magnetic valve is opened, and pressure does not drop completely but for a short time is maintained at a predetermined level, in order to reduce pressure completely by the second stage of the magnetic valve for the ending of the main fuel injection.

Normally the fuel injection pumps can operate without preliminary injection when the magnetic valve 11 remains closed from the start. When the cam drive starts to rotate the pump piston 1 is moved upwards so that fuel which flows through feeding passage 5 and filling grooves 14 into the pump working chamber 2 is compressed, and pressure in the pump working chamber 2 is increased. This increase in pressure opens the injection valve 41. The valve-closing member 7 is closed, as well as the magnetic valve 11. As the cam of the cam drive is rotated further the pump piston 1 moves further upwardly to further compress the fuel until magnetic valve 11 is opened. Pressure in the pump working chamber 1 is reduced by the feedback passage 16 so that the injection valve 41 is closed. A new cycle can start thereby.

It will be understood that each of the elements described above, or two or more together, may also find a useful application in other types of fuel injection pumps differing from the types described above.

While the injection has been illustrated and described as embodied in a fuel injection pump, it is not intended to be limited to the details shown, since various modifications and structural changes may be made without departing in any way from the spirit of the present invention.

Without further analysis, the foregoing will so fully reveal this gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a fuel injection pump for internal combustion engines, comprising housing means defining a pump working chamber; at least one pump piston movably guided in said working chamber; a fuel injection valve; means to connect said chamber to said fuel injection valve during an advancement stroke of said pump piston to open or close said fuel injection valve, said housing means including a first unloading passage connected to said chamber, said housing means further including an unloading chamber connectable to said first unloading passage, and a second unloading passage connected to said unloading chamber to unload the latter; a controlling member controlling said first unloading passage to close or open the latter; a restoring spring positioned in said unloading chamber and biasing said controlling member in a direction of closing, the improvement comprising said first unloading passage having a valve seat with which said controlling member cooperates as a valve closing member, said controlling member being formed so that an opening pressure thereof is higher than the opening pressure of said fuel injection valve, said valve seat and said second unloading passage being connected with one another in an unthrottled manner; and a further valve operating so that in a first operating range said second unloading passage is open at the beginning of the advancement stroke of said pump piston by said further valve enabling a pre-injection of fuel, closed after opening of said controlling member for starting a main fuel injection and again opened for ending at the beginning of the advancement stroke of said pump piston for starting a fuel injection without preinjection and finally opened again for ending the fuel injection.

2. The pump as defined in claim 1, wherein said valve closing member is formed as a pressure equalizing valve.

3. The pump as defined in claim 1, wherein said unloading chamber is cylindrical and said valve closing member includes a cylindrical portion slidable in said unloading chamber, said cylindrical portion having a diameter which is greater than a diameter of said valve seat, said cylindrical portion being provided with overflow passages.

4. The pump as defined in claim 1, wherein said further valve is an electrically actuated valve.

5. The pump as defined in claim 4, wherein said electronically actuated valve is an electro-magnetic valve.

6. The pump as defined in claim 5, wherein said electro-magnetic valve is coaxial to said valve closing member.

7. The pump as defined in claim 2, wherein said valve closing member has a backside, said restoring spring acting on said backside and being adjustable in dependence upon operational parameters of the internal combustion engine.

8. The pump as defined in claim 4, wherein one of said first and second unloading passages has a variable flow through cross-section whereas an opening phase of said electrically-actuated valve is adjustable before an end of a fuel injection.

9. The pump as defined in claim 1, which is formed as a distributor type fuel injection pump.

10. In a method for controlling a fuel injection pump for an internal combustion engine with periodical cycles of pump piston pump motions and high pressure formation for fuel injection nozzles with a control of a duration of a high pressure pump motion per pump cycle for controlling an amount of fuel being injected, the method comprising the steps of providing in the fuel injection pump a working chamber limited by a pump piston, a fuel injection valve connected to said working chamber, a first unloading passage connected to said chamber, an unloading chamber connectable to said first unloading passage, and a second unloading passage connected to said unloading chamber to unload the latter; controlling said first unloading passage with controlling a high pressure pump rate by controlling an amount of fuel removed by a fuel unloading member which periodically permits high pressure to said pump working chamber or pressure to said unloading chamber; providing an electrically-actuated valve to open and close said unloading chamber, the improvement comprising the steps of opening said electrically-actuated valve in a first operating range of the fuel injection pump for controlling the amount of injected fuel during the start of a pump stroke of the pump piston; closing said valve after a predetermined piston pump stroke and opening said valve again for ending the fuel injection; forming said fuel unloading member as a pressure valve operated with an opening pressure which is higher than an opening pressure of said fuel injection valve; and closing said electrically-actuated valve in a second operating range for starting the pumping of said piston and opening said electically-actuated valve for ending the fuel injection.

11. The method as defined in claim 10, wherein said electrically-actuated valve is an electro-magnetic valve the closing of which can vary an interval between a preliminary fuel injection and a main fuel injection.

* * * * *